United States Patent [19]

Gueret

[11] 4,211,217

[45] Jul. 8, 1980

[54] BRUSH FOR BRUSHING THE HAIR OR MASSAGING THE CUTANEOUS COVERING

[75] Inventor: Jean-Louis H. Gueret, Paris, France

[73] Assignee: L'Oreal, Paris, France

[21] Appl. No.: 32,686

[22] Filed: Apr. 23, 1979

[30] Foreign Application Priority Data

Apr. 24, 1978 [FR] France ..... 78 12062

[51] Int. Cl.[2] ..... A61H 7/00

[52] U.S. Cl. ..... 128/67; 15/186; 15/196; 132/85; 300/8

[58] Field of Search ..... 128/62 R, 62 A, 67, 128/65; 15/110, 187, 188, 190, 195, 196, 159 A, 167, 186, 193; 300/2, 8, 9, 21; 132/85, 120, 121

[56] References Cited

U.S. PATENT DOCUMENTS

| | | | |
|---|---|---|---|
| 2,486,847 | 11/1949 | Hokett | 15/186 |
| 2,556,691 | 6/1951 | Harshbarger | 15/186 |
| 2,599,191 | 6/1952 | Meunier | 15/167 |
| 2,979,362 | 4/1961 | Hovorka | 15/159 A |
| 3,251,596 | 5/1966 | Niizaki | 15/159 A |
| 3,449,784 | 6/1969 | Moss | 300/21 |
| 3,641,610 | 2/1972 | Lewis | 300/21 |
| 3,843,990 | 10/1974 | Lardenois | 132/85 |

*Primary Examiner*—Lawrence W. Trapp
*Attorney, Agent, or Firm*—Brisebois & Kruger

[57] ABSTRACT

A hair and massage brush in which each bristle is a bent loop projecting from a perforated support. The ends of the loops extend through perforations in the support and are fixed by fusing the ends into a ball of a size greater than a perforation of the support. When two bristles extend from each perforation, their four ends are fused into a single ball.

8 Claims, 2 Drawing Figures

BRUSH FOR BRUSHING THE HAIR OR MASSAGING THE CUTANEOUS COVERING

BACKGROUND OF THE INVENTION

It is known that in brushes of a conventional type, particularly hair brushes, the strands or bristles are assembled on a support plate which is itself mounted on a support integral with the handle. In one known embodiment, the bristles are obtained from filaments folded in two; the two end legs of the loops thus formed are threaded into perforations previously made in the support plate and project from the front face of the plate to form the bristles of the brush. Thus, one filament yields two bristles and in general there are two filaments or four bristles provided for each perforation. For assembling the strands on the support plate, particularly when they are made from synthetic fibers, the loop-shaped portions of the filaments which are on the rear face of the plate are transformed by fusing or melting into balls which maintain the bristle in the perforation of the plate. The brush of the type described above, as well as most hair brushes which are currently used, have the disadvantage that the tip of these strands may present sharp edges liable to injure or irritate the scalp. Moreover, even if the tips of the strands are rounded, the risk of injury or irritation is not entirely eliminated, due to their small radius of curvature.

SUMMARY OF THE INVENTION

An object of the present invention is to remedy the above disadvantage by providing a brush usable not only for brushing the hair but also for massaging the cutaneous covering, and the bristles of which can in no way injure or irritate the skin of the user. According to the invention, the bristles are obtained from filaments folded into a loop the two free ends of which are coupled to the support, so that the tip of the bristles is formed by the rounded part of the loops. In a preferred embodiment, the free ends of the loops pass through perforations made in the support and are fused or welded together so as to form balls on the rear face of the support, these balls preventing the loops from being detached from the support.

The present invention has thus as its object the novel industrial product in the form of a brush usable particularly for massaging the cutaneous covering or for brushing the hair, this brush comprising at least one assembly of strands or bristles on a perforated support, the bristles being folded to form loops on the front face of the perforated support, both ends of each bristle being threaded into a perforation of the support and projecting from the rear face of the support, characterized by the fact that the ends of at least one bristle, which are threaded into the same perforation, are welded together so as to constitute, by melting the material from which the strands are formed, a ball whose section is greater than that of the perforations of the support.

In a preferred embodiment, the strands are made from a plastic material; the hardness of the strands depends on their length; the height of the strands is advantageously between 0.5 cm and about 1.5 cm; the support for the strands is made from a flexible material and is mounted on a rigid frame; the support for the strands is formed by at least one rubbery fabric; in each of the perforations of the support are threaded the ends of two strands; the flexible support for the strands comprises an elliptical shaped piece, and the rigid frame which is intended to receive it has an elongated cavity whose longitudinal section is also elliptical; the frame or mount is integral with a handle, which either forms a single part with the frame or is inserted into the frame.

As we have seen, the brush of the invention may be used not only for massaging the skin but also for caring for the hair. As far as the hair is concerned, the strands of the brush of the invention cannot, contrary to the hair brushes known and used up to now, injure or irritate the scalp since the "tips" are formed from folded portions, rounded and in the shape of loops. The brush of the invention thus allows vigorous massaging of the scalp which promotes the blood flow without risk of injuring the scalp. Futhermore, the brush of the invention carries solutions well, because of the configuration of the strands. In fact, if the brush is dipped directly in a receptacle containing for example a hair lotion, the lotion is retained in the loops of the brush and can then be easily brought into contact with the hair which it is desired to treat. The result is that the application on the hair of hair lotions is greatly facilitated by the use of the brush of the invention.

The brush of the invention may advantageously be used in massaging the cutaneous covering for activating the surface circulation and restoring tone and vigor to the tissues. The cutaneous massaging effected by means of the brush of the invention accelerates the exchange process at the level of the teguments, causing a slight local rise in temperature (rubefaction and slight hyperaemia), thus promoting, by mechanical action, a better penetration of the treatment product to be applied and consequently improves its action. Furthermore, with its mounting system and its loop-shaped bristles or strands, the brush of the invention allows a massaging operation to be carried out without scratching or irritating the skin and can be very easily cleaned so as to comply with the highest hygienic standards.

For a better understanding of the subject of the present invention, there will be described hereafter, by way of a purely illustrative and non-limiting example, one embodiment shown in the accompanying drawing.

DETAILED DESCRIPTION

Figure 1:
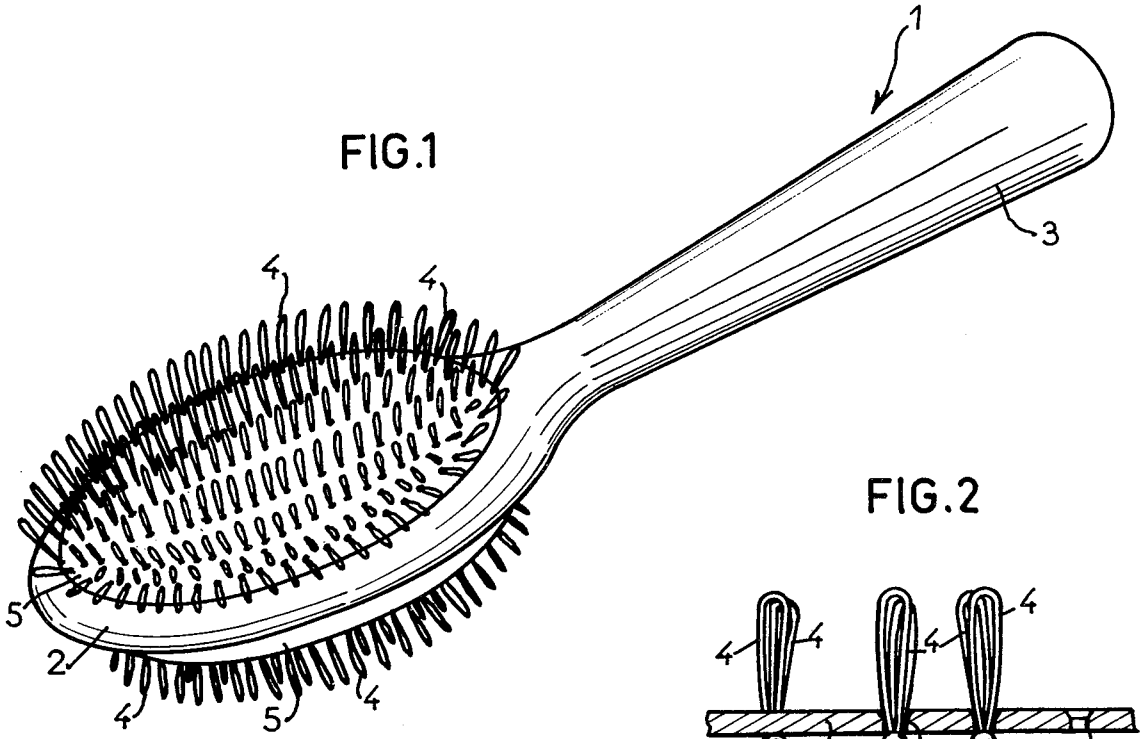
FIG. 1 shows, in perspective, a brush according to the invention.

Referring to the drawing, there can be seen, shown in its entirety by 1 a brush whose mount or frame 2 forms a single part with a handle 3. Conventionally, mount 2 and handle 3 which is integral therewith, may be formed from any appropriate material, for example from wood or by moulding a plastic material. As a variation, handle 3 may form an independent part which is attached to mount 2. On each of the faces of mount 2 there is provided an elongated cavity whose longitudinal section is substantially elliptical; inside this cavity is mounted the strand support 4 of the brush.

In this embodiment, the support on which the strands 4 of the brush are assembled, is formed from a flexible disc 5 having an elliptical outline; the support disc 5 is made from a rubbery fabric. Since the support disc 5 has an area which is slightly greater than that of the opening of the cavity of the mount 2, which is intended to receive it, disc 5 presents, when it is mounted on mount 2, a convex curved configuration, the convexity being directed outwardly of the brush.

Figure 2:
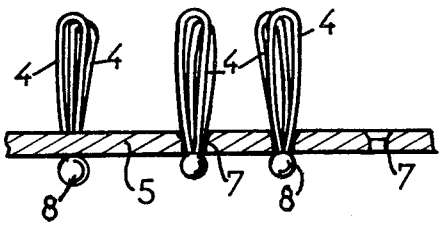
FIG. 2 shows, on a larger scale, a partial section of the strand support forming part of the brush of FIG. 1.

The support disc 5 is previously provided with perforations 7 before assembling the strands 4. The originality of the invention comes from the fact that the strands 4 are formed by plastic material filaments which are folded in the middle to form loops, their two end legs being threaded into the perforations 7 of the support disc 5. Into each perforation 7 of the support disc 5 are threaded the end legs of two loops which project slightly from the rear face of said disc. To provide the mechanical connection of the loops with the support disc 5, the projecting part of the end legs of the loops are heated to form, by melting the plastic material from which they are made, balls 8 whose section is greater than that of the perforations 7. Balls 8 accordingly prevent strands 4 from coming out of their perforations. As can be seen in FIG. 2 of the drawing, each ball 8 is formed by melting together the four end legs of two loops threaded into the same perforation 7.

Thus, strands 4 of the brush of the invention form, on the front face of the support disc 5, loops whose rounded end forms the "tip" of the strands or bristles. It follows then that strands 4 in the shape of a loop have a less aggressive and less rough effect than the ends of the strands of a conventional brush when they come into contact with the skin or the scalp during a brushing or massaging operation. Moreover, as previously stated, the brush of the invention facilitates the application of a liquid or pasty product since it is retained by the loops. Support disc 5 can be fixed in the cavity of mount 2 with an adhesive. The cavity of mount 2 can include a rigid wall beneath support disc 5.

It is to be understood of course that the embodiment described above is in no wise limiting and may give rise to any desirable modifications without departing from the scope and spirit of the invention.

What is claimed is:

1. A brush for massaging the cutaneous covering or for brushing the hair, and comprising, at least one assembly of bristles on a perforated support having plural perforations, each bristle being bent to form a loop and having two ends, said loops projecting from a front face of the perforated support, and the two ends of a bristle extending into a perforation of the support and projecting from a rear face of said support, said ends of bristles threaded into the same perforation being fused together to comprise a ball whose section is greater than that of the perforations of the support, to secure the bristles in the perforations.

2. The brush as claimed in claim 1, wherein said bristle comprises plastic material filaments.

3. The brush as claimed in claim 1 wherein the height of the bristles is between 0.5 cm and about 1.5 cm.

4. The brush as claimed in claim 1, characterized by the fact that the perforated support for the bristles comprises a flexible material which is mounted on a rigid frame.

5. The brush as claimed in claim 4, wherein said flexible material of the support comprises a rubbery fabric.

6. The brush as claimed in claim 1 wherein the ends of two bristles extend into each perforation of the support.

7. The brush as claimed in claim 4, wherein the flexible support comprises an ellipse-shaped cut-out and the rigid frame for said support has an elongated cavity whose longitudinal section is also elliptical.

8. The brush as claimed in claim 7, characterized by the fact that the frame is integral with a handle.

* * * * *